United States Patent [19]

Arai

[11] Patent Number: 4,866,792

[45] Date of Patent: Sep. 19, 1989

[54] SHIELD MOUNTING ASSEMBLY FOR A SAFETY HELMET

[76] Inventor: Michio Arai, 1-164 Horinouchi, Ohmiya-shi, Saitama-ken, Japan

[21] Appl. No.: 198,340

[22] Filed: May 25, 1988

[30] Foreign Application Priority Data

Jun. 9, 1987 [JP] Japan ..... 62-144449

[51] Int. Cl.[4] ..... A42B 3/02; A61F 9/04

[52] U.S. Cl. ..... 2/424

[58] Field of Search ..... 2/2.1 A, 5, 6, 9, 410, 2/424, 425, 429

[56] References Cited

U.S. PATENT DOCUMENTS 4,794,652 1/1989 Von Planta et al. ..... 2/424 X

FOREIGN PATENT DOCUMENTS

| | | | |
|---|---|---|---|
| 3607483 | 9/1987 | Fed. Rep. of Germany | 2/425 |
| 20963 | 2/1920 | France | 2/6 |
| 1329759 | 8/1987 | U.S.S.R. | 2/424 |
| 1560723 | 2/1980 | United Kingdom | 2/424 |
| 2087220 | 5/1982 | United Kingdom | 2/425 |
| 2087222 | 5/1982 | United Kingdom | 2/425 |

*Primary Examiner*—Wm. Carter Reynolds
*Attorney, Agent, or Firm*—Klauber & Jackson

[57] ABSTRACT

An assembly for mounting a shield on a safety helmet of the type having a helmet body in the front opening, includes two male locking members, each secured to a respective left and right outer surface of the helmet body, and two female locking members, each secured to a respective left and right shield side. Each male locking member includes a recess having an inlet portion at the periphery thereof and an engaging shoulder. Each female locking member includes a boss and a guide piece at the periphery thereof for insertion in a respective recess and inlet portion only when the shield is moved to a disengagement position above the normal upper limit position. The guide piece of each female locking member is engaged by the engaging shoulder of the respective male locking member when the shield is moved out of the disengagement position, with the recess and boss rotatably supporting the shield for rotational movement on the helmet body. A moderating device for guiding the shield during rotation thereof includes a resilient engaging piece mounted on each male locking member and an arcuate guide groove is formed in the respective female locking member for receiving the resilient engaging piece and guiding the same during rotation of the shield. A stopper is mounted on the male locking member for engaging the lower peripheral edge of the shield during normal operation thereof, so as to define the upper limit of rotation of the shield at such time.

5 Claims, 3 Drawing Sheets

SHIELD MOUNTING ASSEMBLY FOR A SAFETY HELMET

BACKGROUND OF THE INVENTION

The present invention relates to an assembly for mounting a shield on a safety helmet having a full-face type or jet type configuration, which is used when riding a motorcycle or driving an automobile.

In a conventional shield mounting construction for a safety helmet having a full-face type or jet type configuration, the shield and an opening adjusting means for the shield are generally mounted by set screws to the helmet body. More specifically, left and right sides of the shield and parts of the opening adjustment means, such as a ratchet mechanism are fixedly mounted to the helmet body through a mounting cover.

With the above-mentioned conventional construction, it is sometimes necessary to disassemble a mounting portion of the shield because the shield does not open and close correctly during use. In such case, when the set screws are removed to remove the shield mounting cover from the helmet body, various parts thereof which limit the opening and closing of the shield, fly apart in a disorderly manner. As a result these parts may be lost.

In addition with such conventional shield mounting construction, removal of the shield can be performed at a position in which the shield is in its normal operational state, that is, at any position from a fully closed position to a fully open position. Therefore, if the set screws become loose, the shield can possibly separate from the helmet body even during a period of operation thereof.

OBJECTS AND SUMMARY OF THE INVENTION

Accordingly, it is an object of the present invention to provide a mounting construction for a shield of a safety helmet that overcomes the aforementioned problems in the prior art.

It is another object of the present invention to provide such a mounting construction in which the shield can be engaged with, and held on the helmet body, without the use of set screws.

It is still another object of the present invention to provide such a mounting construction in which mounting and removal of the shield can be carried out only when the shield has been moved to a position which is not in its normal operational state.

It is yet another object of the present invention to provide such a mounting construction in which even if the shield or shield mounting cover is removed, constituent members of an opening and closing adjusting mechnism do not scatter or fly apart in pieces.

In accordance with an aspect of the present invention, an assembly for mounting a shield on a safety helmet of the type having a helmet body and a front opening, includes a first locking member secured to left and right outer surfaces of the helmet body, the first locking member including first support portion means for rotatably supporting the shield; a second locking member secured to left and right sides of the shield, the second locking member including second support portion means for fitting into and engaging with the first support portion means so as to releasably lock the shield on the helmet body for rotation thereon; moderating means in the first locking member and the second locking member for guiding the shield during rotation thereof; stopper means on at least one of the first and second locking members for defining an upper limit of rotation of the shield during normal operation of the helmet; and the first and second support portion means including means for permitting disengagement of the first and second support portion means only when the shield is moved to a disengagement position above the upper limit of rotation, the disengagement position being attained only during non-normal operation thereof.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
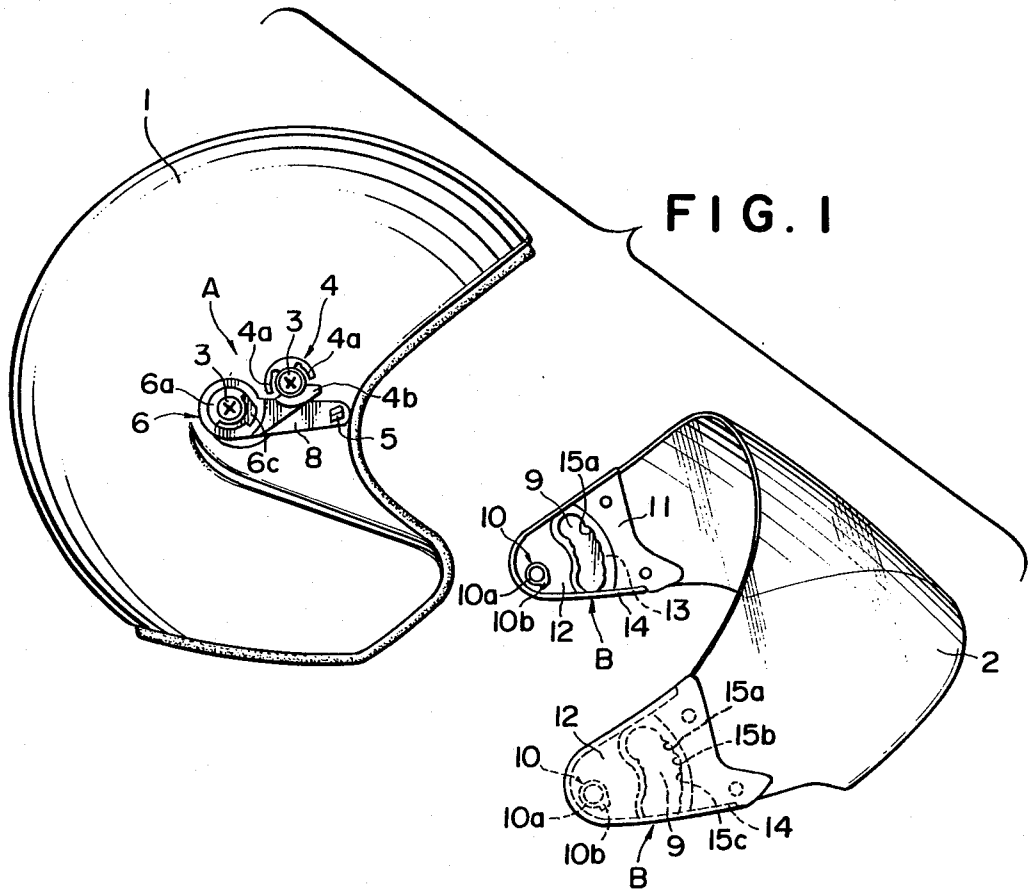
FIG. 1 is an exploded perspective view of a helmet according to the present invention.
Figure 2:
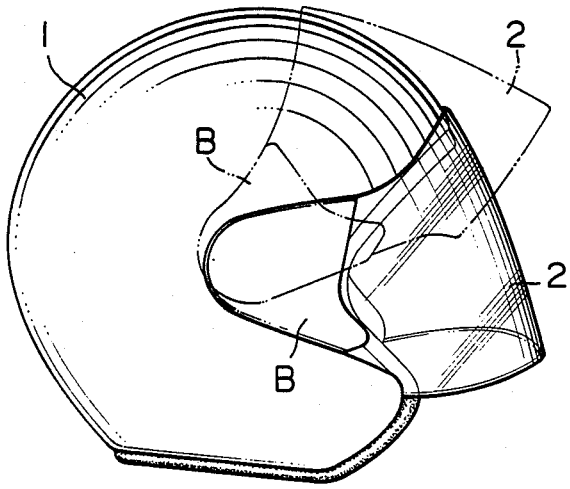
FIG. 2 is a side elevational view of the helmet of FIG. 1, shown in an assembled condition.
Figure 3:
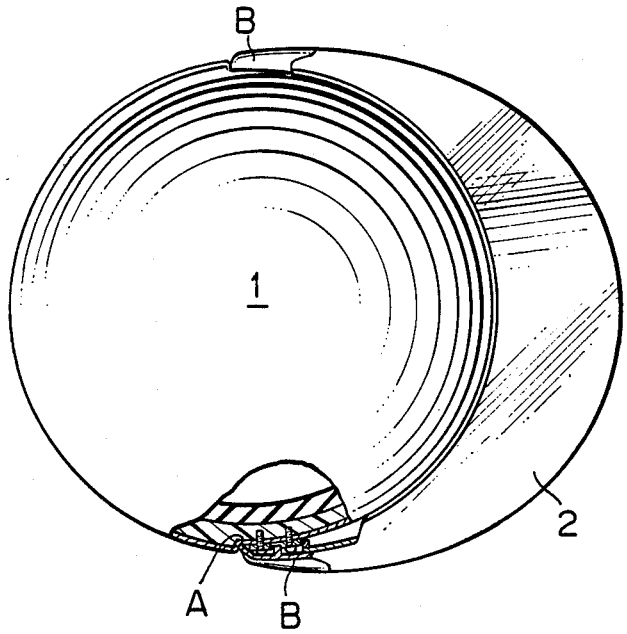
FIG. 3 is a top plan view of the helmet of FIG. 1, shown partly cut away.
Figure 4:
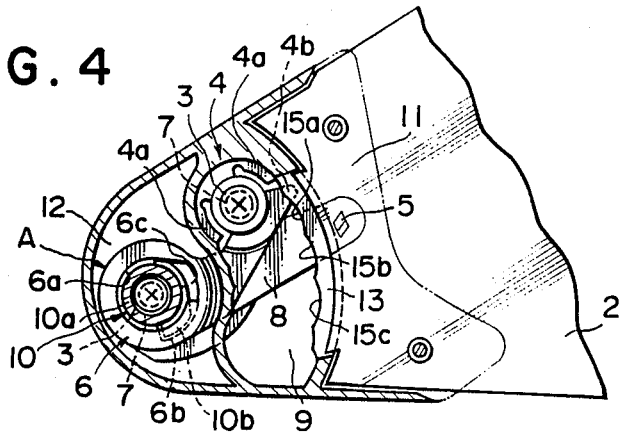
FIG. 4 is an enlarged plan view of the mounting assembly of the helmet of FIG. 1, in which the shield is in a fully closed condition.
Figure 5:
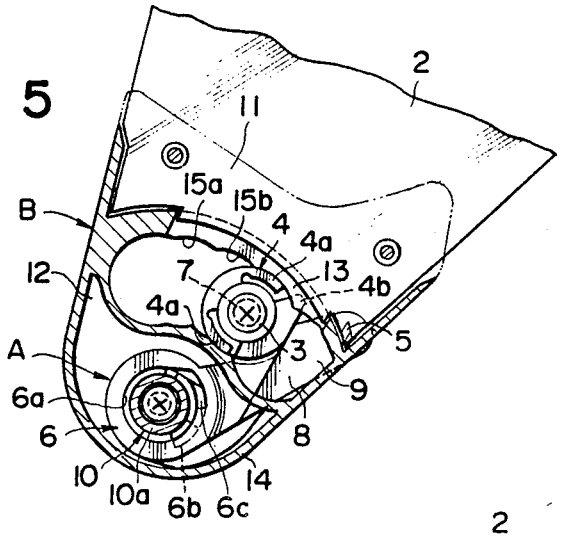
FIG. 5 is an enlarged plan view of the mounting assembly of FIG. 4, in which the shield is in a fully open condition during normal operation.

An embodiment of the present invention will now be described with reference to the drawings, in which there is shown a helmet body 1, a shield 2, a male locking member A secured to the left and right outer surfaces of helmet body 1, and a female locking member B mounted integral with the left and right sides of shield 2.

Helmet body 1 has a jet-type shape, which is generally known although a full-face type configuration can also be used. Male locking member A for supporting shield 2 between its open and closed positions is secured by means of set screws 3 to the left and right outer surfaces of helmet body 1.

Male locking member A comprises an elastically acting moderating means 4, a stopper 5 for defining the upper limit of rotation of shield 2 and a support portion 6 around which shield 2 is rotated, all of which are integrally formed of a synthetic resin material. Through holes 7 into which set screws 3 are fit, are bored in the center of moderating means 4 and in the center of support portion 6.

Moderating means 4 comprises an arcuate resilient piece **4*a* which resiliently functions in a diametrical direction against the peripheral edge of an arcuate guide groove 9 formed in female locking member B, and an engaging piece 4*b* which fits in a stop groove 13 formed in the peripheral edge of arcuate guide groove 9. Resilient piece 4*a* fits into recesses 15*a*, 15*b* and 15*c* formed every preset angle in the inside and outside diameter groove edges of arcuate guide groove 9 so that shield 2** can be moved and held at small incremental angles.

Stopper 5 defines the fully open upper limit position of shield 2, and is integrally projected on a base plate 8 connecting moderating means 4 and support portion 6. Stopper 5 substantially stands upright so that one side thereof comes into abutment and engagement with the lower peripheral edge of female locking member B when shield 2 is in its upper open position, the other side thereof being formed with an inclined surface so that the lower edge of female locking member B may smoothly ride thereover.

Support portion 6 is provided at a position of the same radial distance from the center of moderating means 4 as stopper 5, while being adjusted to the radius of curvature of arcuate guide groove 9 in female locking member B. Support portion 6 comprises a recess **6*a* into which is fit a boss 10*a* of support means 10 of female locking member B. An engaging shoulder 6*b* of support portion 6 engages with a guide piece 10*b* projected on the peripheral surface of boss 10*a*. Support portion 6 also includes an inlet portion 6*c* which receives guide piece 10*b* of support means 10, inlet portion 6*c* being cut and formed at the periphery of recess 6*a*, such that engaging shoulder 6*b* and inlet portion 6*c* are formed with the same peripheral diameter. The position of inlet portion 6*c* which is formed in the periphery of recess 6*a* is such that only when shield 2 is positioned upwardly to its full, open upper limit, guide piece 10*b* of support means 10 of female locking member B can be either fit into or disengaged from inlet portion 6*c***.

Female locking member B may be engaged with or disengaged from male locking member A, and comprises arcuate guide groove 9 which receives and is engaged with moderating means 4 of male locking member A, and support means 10 at the center of curvature of arcuate guide groove 9. Both guide groove 9 and support means 10 are integrally formed on a base plate 12 made of a synthetic resin material having a mounting portion 11 for mounting base plate 12 on shield 2, mounting portion 11 being secured by set screws to the inner surface of shield 2. However, it will be appreciated that female locking member B can be formed integrally as part of shield 2.

As discussed above, annular guide groove 9 is a groove having a width which receives resilient piece **4*a* of male locking member A, and is formed with recesses 15*a*, 15*b* and 15*c* every preset angle at the front and rear groove edges thereof. Engaging groove 13 is formed in the outside diameter groove edges of annular groove 9, engaging groove 13 being formed continuously, starting from the lower side of annular guide groove 9**.

Support means 10 comprises circular boss **10*a* which fits into recess 6*a* of support portion 6 and guide piece 10*b* horizontally projected on the outer peripheral surface of boss 10*a***, as discussed above.

An engaging projecting edge 14 is integrally formed on the lower side edge of base plate 12 to which female locking member B is mounted, whereby engaging projecting edge 14 abuts with stopper 5 of male locking member A to thereby define the fully open, upper limit position of shield 2.

Next, mounting and removal of the above-described shield 2 will be described when shield 2 is in its fully open, upper limit position. First, when female locking member B on shield 2 is placed in engagement with male locking member A which is secured to helmet body 1, boss **10*a* and guide piece 10*b* of support means 10 of female locking member B on shield 2, are brought into registration with recess 6*a* and inlet 6*c* of support portion 6 of male locking member A. Shield 2 is then turned downwardly about support means 10 which is fit into support portion 6. Accordingly, engaging projecting piece 4*b* of male locking member A is fit into engaging groove 13 of female locking member B, and guide piece 10*b* of female locking member B is fit into engaging shoulder 6*b* of male locking member A, to prevent axial disengagement thereof, by rotating female locking member B about support means 10** with respect to male locking member A.

In the manner described above, shield 2, which is engaged with and supported on helmet body 1, has a limited rotational range from the beginning or upper end of annular guide groove 9 to a point at which rotating engaging projecting edge 14 of female locking member B abuts against stopper 5 of male locking member A. With this arrangement, shield 2 can be opened in a stepwise manner.

Figure 6:
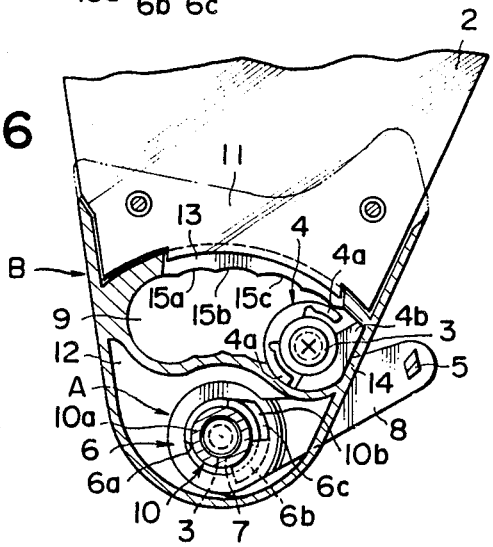
FIG. 6 is an enlarged plan view of the mounting assembly of FIG. 4, in which the shield is in an extended position for mounting or removing.

In order to remove shield 2 from helmet body 1, shield 2 is rotated upwardly to cause engaging projecting edge 14 to abut against stopper 5. Then, female locking member B is spread or twisted outwardly to remove engaging projecting edge 14 from stopper 5, whereby shield 2 is further rotated upwardly, until guide piece **10*b* of support means 10 registers with inlet 6c of support portion 6, and engaging projecting piece 4*b* of moderating means 4 disengages from engaging groove 13 at the end of arcuate guide groove 9, as shown in FIG. 6. Accordingly, in such position female locking member B can be separated from male engaging member A. In other words, mounting and removal of shield 2 are effected, in normal use, when shield 2 is further turned upwardly from its fully open, upper limit position to a position where shield 2** is not normally positioned.

Thus, mounting and removal of shield 2 can be carried out only at a special position and only when there is a spreading or twisting of shield 2 that is not applied in normal use. This occurs when shield 2 abuts against stopper 5 for defining a fully open upper limit position in a normal operational state, and shield 2 is rotated to a position beyond the upper limit.

Moreover, since engaging members for shield 2 are formed by male locking member A secured to helmet body 1 and female locking member B mounted on shield 2, even if shield 2 is removed, the engaging members are not scattered about or lost, but rather, mounting and removal of shield 2 can be carried out safely.

Furthermore, since mounting and removal of shield 2 can be achieved, only when shield 2 is further moved upwardly from the fully open upper limit position at which the shield is not normally positioned, there occurs no possible disengagement of shield 2 from the helmet in the normal operational state.

Having described a specific preferred embodiment of the invention with reference to the accompanying drawings, it will be appreciated that the present invention is not limited to that precise embodiment and that various changes and modifications can be effected therein by one of ordinary skill in the art without departing from the spirit or scope of the invention, as defined by the appended claims.

What is claimed is:

1. An assembly for mounting a shield on a safety helmet of the type having a helmet body and a front opening, said assembly comprising:

(a) a first left side locking member secured to a left outer surface of the helmet body, said first left side locking member including first left side support portion means for rotatably supporting a left side of the shield;

(b) a first right side locking member secured to a right outer surface of the helmet body, said first right side locking member including first right side support portion means for rotatably supporting a right side of the shield;

(c) a second left side locking member secured to the left side of the shield, said second left side locking member including second left side support portion means for fitting into and engaging with the first left side support portion means so as to releasably lock the left side of the shield on the left side of the helmet body for rotation thereon;

(d) a second right side locking member secured to the right side of the shield, said second right side locking member including second right side support portion means for fitting into and engaging with the first right side support portion means so as to releasably lock the right side of the shield on the right side of the helmet body for rotation thereon;

(e) moderating means on at least one of the first side locking members and on at least a corresponding one of the second side locking members for guiding the shield during rotation thereof;

(f) stopper means on at least one of said first and second locking members for defining an upper limit of rotation of the shield during normal operation of the helmet;

(g) said first and second left side support portion means including means for permitting disengagement of said first and second left side support portion means only when the left side of the shield is moved to a disengagement position above the upper limit of rotation, said disengagement position being attained only during non-normal operation thereof; and (h) said first and second right side support portion means including means for permitting disengagement of said first and second right side support portion means only when the right side of the shield is moved to a disengagement position above said upper limit of rotation, said disengagement position being attained only during non-normal operation thereof.

2. An assembly according to claim 1; wherein each said first support portion means includes a recess having an inlet portion formed at a periphery thereof, and an engaging shoulder; and each said second support portion means includes a boss having a guide piece at a peripheral surface thereof, with said boss and guide piece fitting within a respective said recess and inlet portion only when said shield is moved to said disengagement position and said guide piece being engaged by a respective said engaging shoulder when said shield is not in said disengagement position so as to prevent removal of said shield, and each said means for permitting disengagement includes a respective said engaging shoulder, inlet portion and guide piece.

3. An assembly according to claim 1; wherein said moderating means includes an arcuate resilient piece on each said respective first locking member and an arcuate guide groove on each said respective second locking member for receiving a respective said arcuate resilient piece and for guiding said arcuate resilient piece in an arcuate manner during rotation of said shield.

4. An assembly according to claim 3; wherein at least one peripheral edge of each said arcuate guide groove has a plurality of recesses for engaging with a respective said arcuate resilient piece, wherein said shield can be moved and held at small incremental angles.

5. An assembly according to claim 1; wherein said stopper means includes a stopper positioned on a respective said first locking member and engaging with a lower peripheral edge of said shield to prevent movement of said shield past said upper limit of rotation during normal operation.

* * * * *